United States Patent [19]

Knöpfel

[11] Patent Number: 5,042,124

[45] Date of Patent: Aug. 27, 1991

[54] MACHINE FOR PUNCHING OUT BUTTERFLY CLIPS FOR FASTENING TO A FRAME OF A SPRING CORE

[75] Inventor: Hans Knöpfel, Roggwil, Switzerland

[73] Assignee: Spuhl AG, St. Gallen, Switzerland

[21] Appl. No.: 498,015

[22] Filed: Mar. 23, 1990

[30] Foreign Application Priority Data

Apr. 5, 1989 [DE] Fed. Rep. of Germany ..... 3910939

[51] Int. Cl.[5] ..... B21F 27/00; B23P 11/00

[52] U.S. Cl. ..... 29/33 K; 29/33 S; 29/34 R; 29/283.5; 29/566.1; 29/788; 140/3 CA; 140/93 D

[58] Field of Search ..... 29/21.1, 33 K, 33 S, 29/34 R, 34 B, 283.5, 437–439, 566, 566.1, 788; 140/3 CA, 11, 57, 93 A, 93 D

[56] References Cited

U.S. PATENT DOCUMENTS

| | | | |
|---|---|---|---|
| 2,537,817 | 1/1951 | Edwards | 140/11 X |
| 2,738,747 | 3/1956 | Derrick | 29/566 X |

FOREIGN PATENT DOCUMENTS

| | | |
|---|---|---|
| 689463 | 3/1940 | Fed. Rep. of Germany . |
| 1060828 | 7/1959 | Fed. Rep. of Germany . |
| 1452558 | 4/1969 | Fed. Rep. of Germany . |
| 2528746 | 12/1976 | Fed. Rep. of Germany . |
| 319667 | 12/1953 | Switzerland . |
| 2020770 | 11/1979 | United Kingdom . |

*Primary Examiner*—Steven C. Bishop

*Attorney, Agent, or Firm*—Baker, Maxham, Jester & Meador

[57] ABSTRACT

A machine in which butterfly clips are prebent and then punched out of steel strip and simultaneously finally bent, such that they fasten together a spring and the frame of a spring core. Thus, both the punching out of the clip and the final bending process, i.e. the connecting process between the frame and spring parts, are carried out in a single tool. The machine therefore operates particularly cost-effectively, because, in comparison with the prior art, the separately punched butterfly clips do not have to be inserted into a separate bending machine.

4 Claims, 4 Drawing Sheets

II
II

MACHINE FOR PUNCHING OUT BUTTERFLY CLIPS FOR FASTENING TO A FRAME OF A SPRING CORE

The invention relates to a machine for punching butterfly clips out of steel strip with a feed mechanism for the steel strip, a work table and a punching tool.

Butterfly clips are used to connect the outer edge of a spring core and the edge springs located there with a surrounding frame.

It has hitherto been usual to punch the butterfly clips out of steel strip in a separate machine and then connect them with the parts of the spring core by means, for example, of a hand tool. However, this is very labour-intensive and particular precautions have to be taken to ensure that the clips are fastened to the parts of the spring core in the correct position.

The invention avoids these disadvantages. The problem on which it is based is that of proposing a machine in which the butterfly clips can be both punched out of the steel strip and connected with the fastening means of the spring core.

To solve this problem, the invention is characterized in that the feed mechanism for the steel strip comprises a bending surface which prebends the steel strip into a round shape when viewed from the side and in which the bent steel strip partially surrounds the spring wire and frame element for fastening the butterfly clip around them holding-down device and a bending member with a shaped working bending surface are provided which bend the prebent butterfly clip into a final position, in which it surrounds the frame and spring elements.

The heart of the invention is thus the combination of a punching tool with a bending tool in a single machine, in such a way that in this machine the butterfly clips are both punched out of the steel strip and simultaneously bent, i.e. connected with parts of the spring core or the spring core frame.

If the elements to be fastened by means of the butterfly clips consist of round frame wire and round spring wire, the work table can be fixed to the frame. However, if the elements to be fastened together are constructed as round spring wire combined with a spring frame with a flat profile, the work table is preferably raisable and lowerable. With this embodiment, therefore, adaptation to the rectangular flat profile of the flat frame occurs, the steel strip being first of all prebent and the prebent steel strip then being lifted over the work table and finally bent.

Further details and important features of the invention can be seen from the following description of exemplary embodiments.

Figures 1, 2, 3:
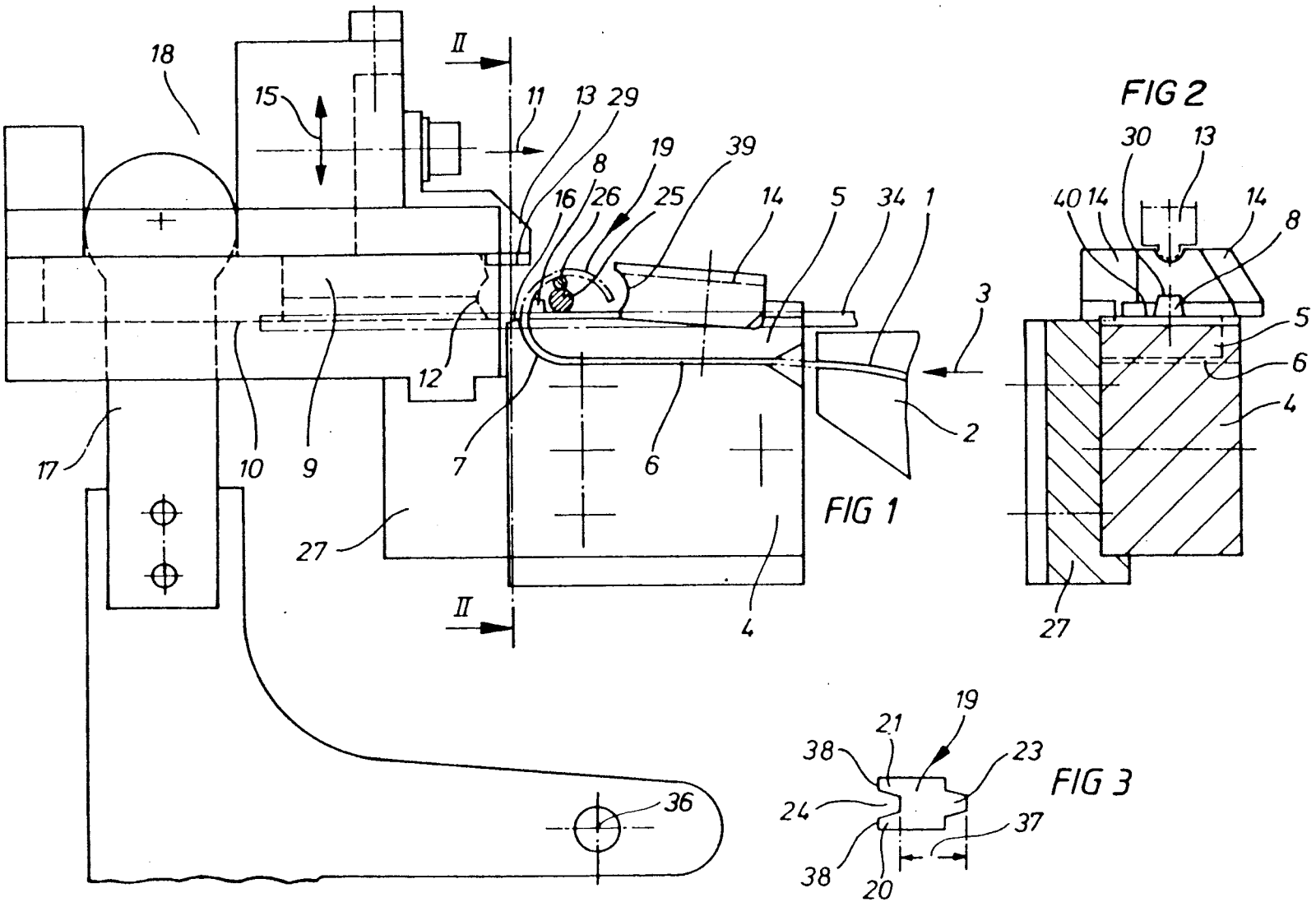
FIG. 1 shows a side view of the most important components of a machine for connecting a frame wire with a spring wire by means of butterfly clips, which are punched out of steel strip in the same machine.
FIG. 2 shows a section along the line II—II of FIG. 1.
FIG. 3 shows a plan view of the flat butterfly clip, as punched in said machine.

In FIG. 1 there are arranged on a machine stand 27 a punching tool guide 10 and also a prebender 4, which is firmly connected with the machine stand 27.

A working piece or centre piece 5 is arranged on the prebender 4, the two above-mentioned parts 4, 5 forming between them a gap 6, into which is fed steel strip 1 in the direction of arrow 3. The feed is effected via a guide piece 2, the steel strip being fed in clip lengths 37 (c.f. FIG. 3).

The definition of the clip length 37, i.e. from the tip of the tab 23 in FIG. 3 to the base of the recess 24 in FIG. 3 also shows that a substantial material saving is made if a clip 19 according to FIG. 3 is directly punched out of the steel strip 1.

At the exit of the gap 6 there is arranged a bending surface 7, at the upper end of which there is arranged a surface 16.

The purpose of this bending surface 7 is to prebend the clips 19 to be worked later, as is shown by the dash-dotted radius in FIG. 1.

In the position shown in FIG. 1, the tool is located in the starting position, i.e. before the production of the punch cut.

A punching tool 9 is accommodated on the punching tool guide 10 to be displaceable in the direction of arrow 11 and in the opposite direction thereto.

A holding-down device 13 is firmly connected with the punching tool 10 via a screw connection, the holding-down device 13 thereby being vertically adjustable and fixable in the direction of arrows 15, as will be described in greater detail below.

The drive of the punching tool 9 and the holding-down device 13 is effected via a driving ram 17, which engages in a recess 18 in the punching tool 9, the driving ram 17 being driven and swivelled about the pivot 36 by means of an articulated lever, not described in any more detail.

At the front end of the punching tool 9 there is provided a cutting plate 12, which is in the form of a trapezium, i.e. has the shape of the recess 24 in the clip 19, as shown in FIG. 3.

Lateral cutting edges are provided laterally on the cutting plate 12, which comprises a projection which corresponds to the recess 24 in the clip 19, said lateral cutting edges on the one hand cutting and on the other hand bending and in this way effecting the cut 38 at the outer ends of the tabs 20 and 21 of the clip 19.

Figure 4:
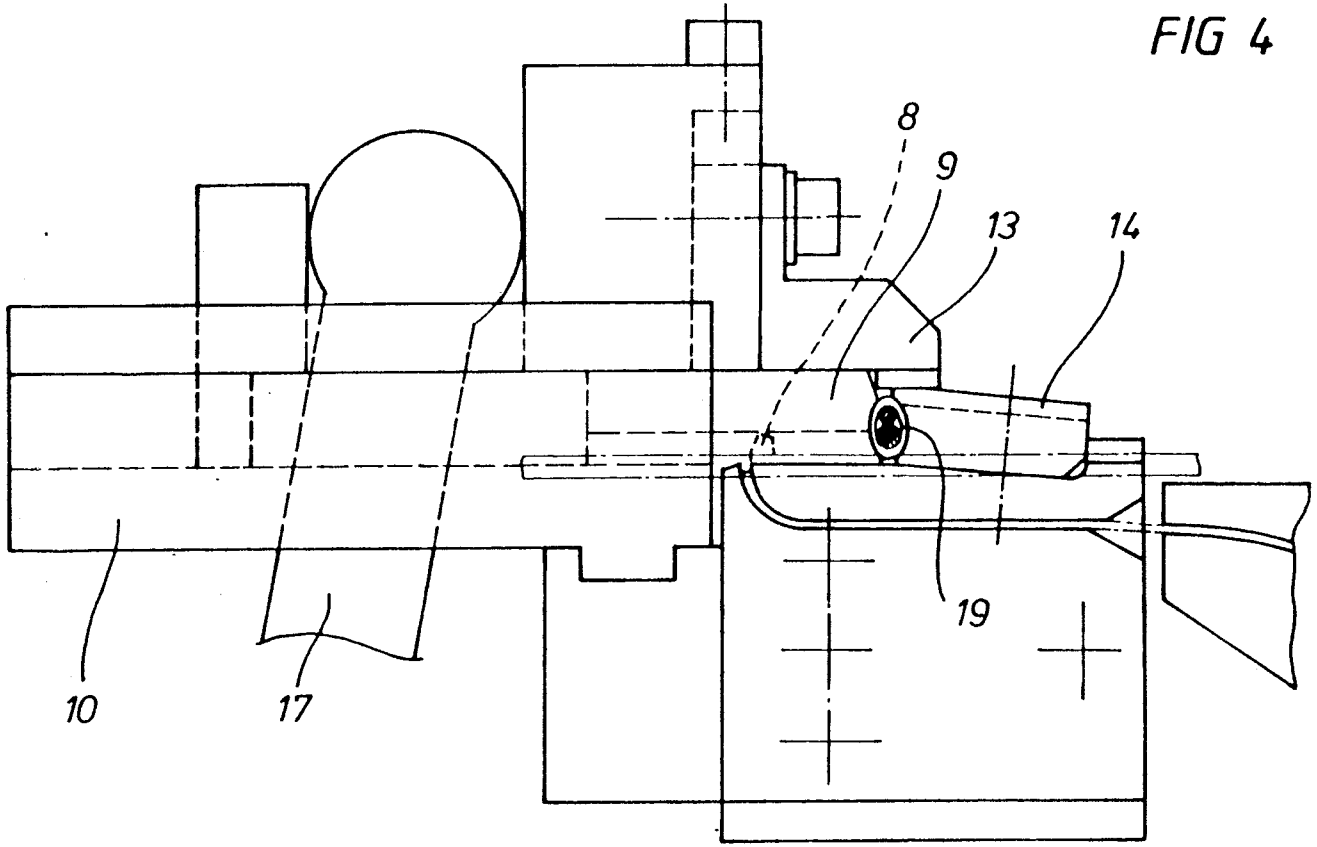
FIG. 4 shows a view corresponding to FIG. 1, which shows that the clip is bent into a form closed in itself and thereby forms the connection.

These cutting edges, which effect the cut 38, serve at the same time to under-grip the tabs 20, 21, which are thereby bent around the frame wire 25, as can be seen from FIG. 4, which is located on a table 34.

The other surfaces of the clip 19 then grip round the frame wire 25, enclosing the spring wire 26, it being important for the front tab 23 to engage precisely in the recess 24 in the bent state.

In this way it is ensured that the clip 19 cannot slip at an angle or become unbent at an angle, and in this way an excellent, firm connection of the two above-mentioned parts 25, 26 is ensured.

The tool then effects a punch cut, the punching tool 9 being moved in the direction of arrow 11 and the tabs 20, 21, which lie opposite each other, being punched in connection with the recess 24 arranged therebetween. A fixed nose 8 is arranged in the region of the centre piece 5, which nose 8 corresponds exactly to the shape of the recess 24. There is thus no steel strip wastage, since what is punched from this steel strip in the region of the nose forms the tab 23 of the subsequent clip.

It is important for the holding-down device 13 to be arranged above the punching tool, the lower edge 29 of said holding-down device 13 bringing the clip 19 into the correct position and preventing the clip from deviating at the top, such that bending is effected around parts 25, 26, as is shown in FIG. 1.

In this way, the parts 25, 26 are pressed together with the clip 19 against the bending or forming surface 39 of the bending member 14, which bending member 14 is fastened to the centre piece 5.

Thus, in this way it is ensured that the front bent piece, on the right-hand side in FIG. 1, of the clip 19 is deflected downwards from the bending surface 39, such that the tab 23 is bent inwards in the clockwise direction into the recess 24.

It can also be seen from FIG. 2 that in the region of the nose 8 a trapeziform cutting edge 30 is provided which punches out the recess 24 in the clip 19.

Horizontal cutting edges 40 laterally adjoin this trapeziform cutting edge 30, which cutting edges 40 effect the cut 38 in the tabs 20, 21. These cutting edges 40 serve to under-grip and bend these tabs 20, 21, in accordance with the above description.

FIG. 4 shows the end of the working cycle, i.e. the punching tool 9 has travelled in the direction of the bending member 14 and has slightly taken with it in the direction of arrow 11 the clip 19 and the two parts 25, 26 to be connected.

In this connection it can be seen that the ram 17 has changed its position.

It can be seen that the clip connects the two parts 25, 26 together both frictionally and positively, and by the engagement of the tab 23 in the associated recess 24 an excellent connection is achieved, which is secured against slipping.

Figure 6:
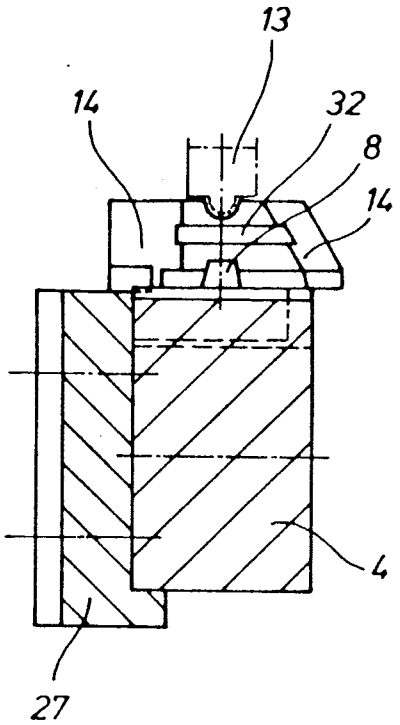
FIG. 6 is a section along line VI—VI of FIG. 5.
Figure 5:
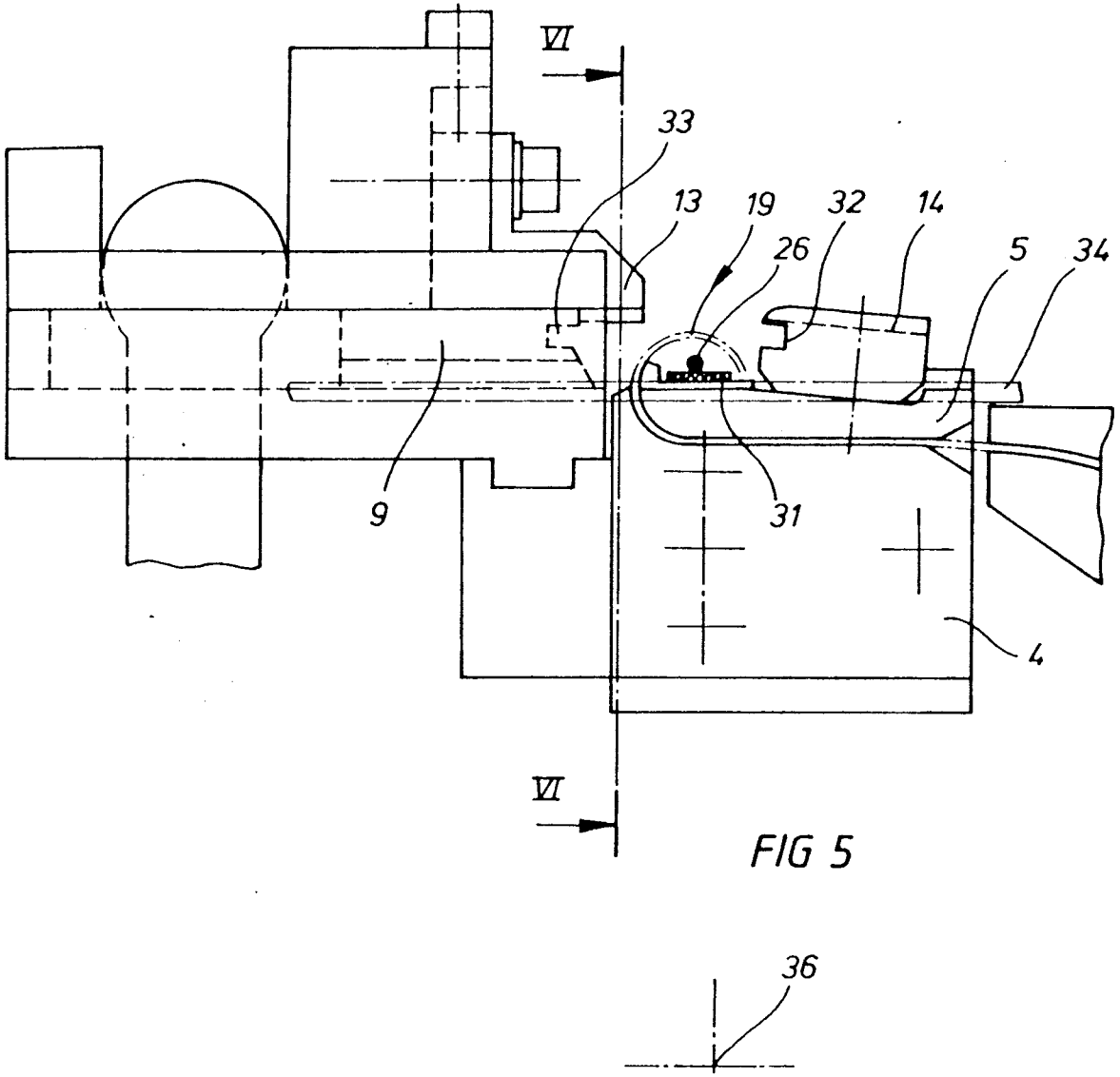
FIG. 5 is a view corresponding to FIG. 1 in a modified embodiment with a raisable and lowerable work table.
Figure 7:
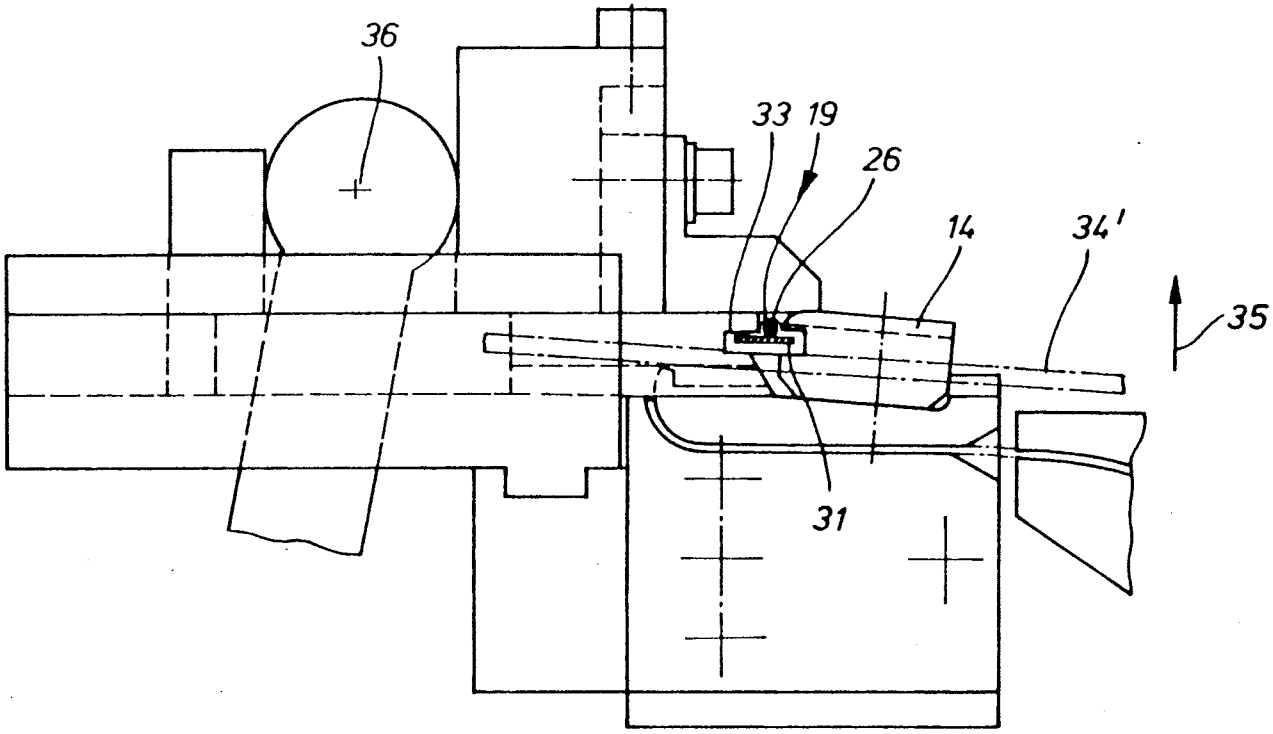
FIG. 7 is a view corresponding to FIG. 4 in this second embodiment.

FIGS. 5–7 show another embodiment of a punching and bending tool, the same reference numerals being used for all parts. The parts are thus identical to those in FIGS. 1 to 4 with the exception of the following features.

To connect a flat frame 31 with an associated spring wire 26 the punching tool 9 and the bending member 14 are both modified.

In the region of the punching tool 9 there is provided a recess 33, which corresponds to an associated recess 32 in the bending member 14.

The flat frame 31 lies on a raisable and lowerable table 34, the table 34 being capable of being raised in the direction of arrow 35 and also lowered again.

In an embodiment not shown in any more detail, the raising and lowering can be effected in such a way that the table 34 is accommodated swivellably on the machine housing by means of a corresponding drive.

In the position shown in FIG. 5, the above-described punch cut for producing the clip 19 is again effected upon the forward movement of the punching tool 9.

The clip thus assumes the position as shown in FIG. 5.

In order then to connect the flat frame 31 with the spring wire 26, the table 34 is raised into its position 34' in the direction of arrow 35 and the recess 33 in the punching tool 9 thus moves into a position in alignment with and opposite to the recess 32 in the bending member 14.

The punching tool 9 thus remains with its recess 33 at the same level, only the flat frame 31 together with the spring wire 26 lying thereon being raised in conjunction with the table 34, the bending member 14 remaining fixed to the framework, i.e. not being raised.

The reason for the raising of the parts 26 and 31 in conjunction with the table 34 is thus that first of all it is desired to achieve an ideal bent curve, as shown in FIG. 5, i.e. it has to be ensured that first of all the upper bent part of the clip overlaps the flat frame 31 with the spring wire 26 lying thereon in the position shown.

Only by raising the two above-mentioned parts and by bringing this prebent part into the two opposed recesses 32, 33 is the clip connection itself undertaken, whereby secure clipping is ensured.

In the embodiment according to FIGS. 1 to 4 such raising was not necessary, because the round construction of the frame wire 25 and the spring wire 26 already provided prebending, while with the rectangular shaping of the flat frame 31 the clip is first of all bent round and then by the action of the two opposed recesses 32, 33 the clip is then bent into an angular or flat shape.

I claim:

1. A machine for forming butterfly clips around parallel elements to be fastened together by means of the clips, the clips being formed from strip stock, said machine having a strip stock feed mechanism, said machine comprising:

a frame;

a work table mounted to said frame;

forming means for prebending the strip stock into a generally round shape pursuant to each stepwise feed motion by said feed mechanism, said prebent strip stock at least partially surrounding the element to be fastened together pursuant to a further feeding motion by said feed mechanism;

a stationary bending member mounted to said machine, said bending member having a first forming surface;

a reciprocably movable punching tool having a second forming surface and a cutting plate; and a holding down device mounted to and moving with said punching tool, said holding down device having means to guide the top of the prebent strip stock to properly engage said first forming surface upon motion of said punching tool toward said first forming surface to thereby form and cut the butterfly clip from the strip stock and engage mating ends of the butterfly clip together around the elements to be fastened together.

2. The machine according to claim 1, wherein said work table is fixed to said frame.

3. The machine according to claim 1, wherein said work table is swivellable or raisable and lowerable with respect to said frame.

4. The machine according to claim 1, wherein each reciprocal motion of said punching tool toward such stationary bending member punches out a first end of the butterfly clip to form a first tab, and simultaneously forms the second, mating end of the next butterfly clip with a recess having flanking second tabs to mate with said first tab, the completion of the punching die motion toward said stationary bending member bending said second tabs and said first tab toward each other to engage said first tab with said recess in a lateral interlocking fashion.

* * * * *